United States Patent [19]

Schenach

[11] 4,085,056

[45] Apr. 18, 1978

[54] INHIBITOR COMPOSITION CONTAINING AN OLIGOMER OIL

[75] Inventor: Thomas Anthony Schenach, Huntington Beach, Calif.

[73] Assignee: Bray Oil Co. Inc., Los Angeles, Calif.

[21] Appl. No.: 780,029

[22] Filed: Mar. 22, 1977

[51] Int. Cl.[2] ..... C10M 1/30; C10M 1/16; C07C 3/18

[52] U.S. Cl. ..... 252/59; 260/683.15 E; 260/666.5

[58] Field of Search ..... 252/58, 59; 260/683.15 E, 683.15 B, 683.15 D, 683.4 R, 666.5, 683.4

[56] References Cited

U.S. PATENT DOCUMENTS

| | | | |
|---|---|---|---|
| 2,404,607 | 5/1942 | Veltman et al. | 260/683.4 R |
| 3,149,178 | 9/1964 | Hamilton et al | 252/59 |
| 3,159,587 | 12/1964 | Uranack et al. | 260/665 R |
| 3,184,409 | 5/1965 | Furey | 252/58 |
| 3,184,413 | 5/1965 | Furey et al | 252/58 |
| 3,493,505 | 2/1970 | Ries et al | 252/59 |
| 3,780,128 | 12/1973 | Skubkin | 260/683.15 B |
| 4,031,158 | 6/1977 | Isa et al. | 260/683.15 B |

FOREIGN PATENT DOCUMENTS

| | | | |
|---|---|---|---|
| 958,868 | 5/1964 | United Kingdom | 526/175 |
| 1,102,030 | 2/1968 | United Kingdom | 252/58 |
| 1,245,231 | 9/1971 | United Kingdom | 252/58 |
| 688,041 | 6/1964 | United Kingdom | 252/58 |

*Primary Examiner*—Delbert E. Gantz

[57] ABSTRACT

An alpha-olefin oligomer oil is first reacted with an alkyl lithium compound and the product subsequently reacted with an alkyl iodide to form a composition found to be an effective inhibitor for the thermal decomposition of alpha-olefin oligomer oils.

6 Claims, No Drawings

INHIBITOR COMPOSITION CONTAINING AN OLIGOMER OIL

This invention relates to synthetic hydrocarbon base oils comprising hydrogenated oligomers of linear alpha-olefins. More particularly, it relates to a method and a composition of matter capable of inhibiting the thermal decomposition of such oils.

Linear alpha-olefin oligomer oils, such as the hydrogenated trimers, tetramers, and pentamers of n-decene-1, have found increasing use in the formulation of lubricants, hydraulic fluids, and other functional fluids. These oils are prepared by the controlled polymerization of $C_6$–$C_{12}$ olefins using catalysts such as boron trifluoride promoted with water, alcohols, or carboxylic acids and anhydrous aluminum chloride — see, for example, Brennan, U.S. Pat. Nos. 3,769,363; Pratt, 3,842,134; Hamilton et al, 3,149,178; Smith et al, 3,682,823. After polymerization, the oligomer oils are usually hydrogenated in order to remove residual unsaturation. The lower viscosity products such as the trimers of decene are used in hydraulic fluids — higher viscosity products such as the tetramers and pentamers of decene are used in automobile crankcase oils, gas turbine lubricants, and so on.

The alpha-olefin oligomer oils have numerous advantages — relatively high flash points, relatively low pour points, good viscosity-temperature properties as illustrated by their viscosity indexes of from about 120 to 160, and excellent oxidation stability. Being hydrocarbons, they can often be formulated with the same types of additive and are compatible with the same seals, gaskets, bearing metals, etc. as are used with conventional petroleum-based lubricants. However, oligomer oils do possess one disadvantage. Their thermal stability is often lower than that of many conventional petroleum-derived base oils. With most oligomer oils, cracking is noticeable at 600° F. and becomes severe as the temperature approaches 700° F. For many applications, of course, this is not a problem, inasmuch as the lubricant or functional fluid is not subjected to temperatures that severe. However, there are some systems (certain types of gas turbine, for example) wherein the oil or fluid must at least temporarily withstand temperatures of 600° F. or higher, and for such applications, the high temperature thermal instability of the oligomer oils is indeed a serious drawback. Thus, there is a need for a method of increasing the thermal stability of these oils without adversely affecting their other properties. I have now discovered such a method.

I have found that if an alpha-olefin oligomer oil is treated with an alkyllithium compound or base of comparable strength, and the product therefrom is subsequently treated with alkyl iodide, a composition is formed with viscosity properties similar to those of the starting oligomer oil, but with dramatically improved thermal stability. This composition may be used as-is in the formulation of lubricant products. Alternately, it may be added to an untreated alpha-olefin oligomer oil, in which case it functions as an inhibitor to reduce the thermal decomposition of said oligomer oil.

PRIOR ART

I am not aware of any prior art disclosing the process of my invention or the inhibitor composition derived therefrom. My inhibitor composition contains trace amounts of chemically combined iodine, and there are references to the use of organic iodine compounds in lubricant and hydraulic oil formulations. For example, Sheratte et al, U.S. Pat. No. 3,865,743, disclose the use of iodonaphthalene or iodobiphenyl at a 2% level in an organic phosphate hydraulic fluid in order to raise its auto-ignition temperature. Roberts et al, U.S. Pat. No. 3,228,880, disclose lubricants for titanium which contain charge transfer complexes of iodine with aromatic compounds as antiwear agents. At least 0.1% by weight iodine is required to achieve the desired reduction in wear. Neither of these references seems to anticipate or make obvious my invention.

DETAILED DESCRIPTION

1. Reactants

The linear alpha olefin oligomer oils to which my invention can be applied have already been described above. They are, of course, well known in the art.

The alkyllithium compounds employed in my process are represented by the formula $C_nH_{2n+1}Li$ wherein "$n$" is an integer from 1 to about 20. The lower molecular weight members of the series are preferred, such as methyl lithium ($n=1$), ethyl lithium ($n=2$), and n-butyllithium ($n=4$). n-Butyllithium n-$C_4H_9Li$ is especially preferred because of its commercial availability. Bases of comparable strength, such as amyl sodium, $C_5H_{11}Na$, may also be used. These compounds are highly reactive and must be handled in an inert atmosphere free of oxygen and moisture.

The alkyl iodides employed in my process are represented by the formula $C_mH_{2m+1}I$, wherein "$m$" is an integer from 1 to about 10. Methyl iodide, $CH_3I$ ($m=1$), is preferred.

The ratio of alkyllithium compound to oligomer oil is preferably from about 0.02 to about 0.7 moles of alkyl lithium per mole of oligomer. Oligomer oils, of course, usually consist of a mixture of individual oligomers — e.g. trimers, tetramers, pentamers, etc. The average molecular weight of such mixtures can be estimated from the bromine number (American Society of Testing Materials method D-1158) before hydrogenation, or by gas chromatography. Thus a decene oligomer oil containing 75% hydrogenated trimer ($C_{30}H_{62}$, molecular weight 422) and 25% hydrogenated tetramer ($C_{40}H_{82}$, molecular weight 562) would have an average molecular weight of 457 ($422 \times 0.75 + 562 \times 0.25$). The ratio of alkyl iodide to alkyl lithium is preferably in the range of from about 1 to about 1.25 moles of alkyl iodide per mole of alkyl lithium.

The alkyl lithium is conventionally handled as a solution in an inert dilluent — for example, n-hexane. It may be convenient to add additional solvent to the reaction mixture, especially when a fairly viscous oligomer oil is being treated. The obvious requirement for such a solvent is that it be inert to the alkyl lithium compound — low-boiling n-alkanes such as n-hexane and n-octane are preferred.

2. Reaction Conditions

The reaction is normally carried out as follows: carefully dried oligomer oil and solvent (if used) are charged to the reactor which is purged with nitrogen, argon, or other inert gas in order to remove air and moisture. The alkyl lithium solution is then cautiously added at a temperature of from 60° F (15° C) to the boiling point of the solvent (e.g. 140° F (60° C) for n-hexane). The mixture is then stirred at ambient temperature or, alternately, heated gently to some temperature just below the decomposition point of the alkyl lithium (usually around 230° F (110° C)). The solvent, if sufficiently volatile, may be distilled off in this step. The reaction mixture is then allowed to cool back to from about 60° F (15° C) to about 140° F (60° C) and the alkyl iodide cautiously added. Some heat evolution will be observed in this step. The mixture is then stirred with or without gentle heating to ensure completeness of reaction, and finally residual alkyllithium compounds are hydrolyzed by the very cautious addition of water or water-alcohol (Considerable evolution of heat is to be anticipated). After hydrolysis, the reaction mixture is water-washed to remove lithium hydroxide and lithium salts, dried, and distilled, preferably under vacuum, up to the initial boiling point of the original oligomer oil in order to remove solvent, molecular iodine, and low-boiling byproducts. The product is usually treated with an activated clay to remove color bodies. In general, it will have a viscosity similar to the oligomer oil starting material, and will contain traces (around 100 ppm) of chemically combined iodine.

3. Thermal Stability Tests

Thermal stability tests were carried out in a 500 ml round-bottom flask, fitted with a heating mantle, a nitrogen inlet tube, and a reflux condenser. Fifty grams of the oil to be tested were charged to the flask and heated to 680° F (360° C) under a slow bleed of nitrogen sufficient to exclude air without removing volatile cracking products. The degree of decomposition was evaluated by the decrease in viscosity of the oil after 1 hour at 680° F. In some cases, a trap was inserted between the flask and the condenser in order to collect low-boiling decomposition products. These were recombined with the oil remaining in the flask after the heating period. This procedure was found to be more severe, the viscosity losses being considerably greater than if the trap was not employed.

My invention will now be illustrated by specific examples.

EXAMPLE 1

A hydrogenated decene oligomer oil having a bromine number of 0.2 and a kinematic viscosity of 19.56 centistokes at 100° F (37.8° C) and containing approximately 75% hydrogenated decene trimer and 25% hydrogenated decene tetramer was heated for 1 hour under nitrogen at 680° F. At the end of the test, its viscosity had dropped to 13.56 centistokes at 100° F (a 30.67% loss).

Two hundred and twenty-five grams of the above oligomer oil were charged to a three-neck round-bottom flask equipped with a stirrer and a nitrogen atmosphere, and 80 milliliters of a 2.29M solution of n-butyl lithium in n-hexane slowly added. The mixture was stirred at ambient temperature (80° F) for ten minutes and then slowly warmed to 200° F at which point the mixture was slightly hazy and most of the n-hexane had distilled off. It was allowed to cool back to room temperature, and 33 grams of methyl iodide were carefully added. A thick white precipitate formed and heat was evolved. The mixture was stirred for 15 minutes, and then 100 milliliters of water cautiously added to hydrolyze residual alkyllithium compounds. After thorough mixing, the batch was allowed to stand for separation of the water layer. It was then water-washed, dried with magnesium sulfate, and stripped to 280° F under nitrogen. After a clay treat, the product was a pale yellow oil with a 100° F viscosity of 19.24 centistokes.

This new oil was subjected to the 680° F 1 hour thermal stability test. The final viscosity was 14.76 centistokes (a 23.29% loss), compared with a 30.67% loss for the original oligomer oil.

EXAMPLE 2

A second batch of inhibitor composition was prepared as follows: 60 milliliters of 2M n-butyl lithium solution in n-hexane was added to 210 grams of the oligomer oil of Example 1 at a temperature of 150° F. The resulting mixture was warmed to 230° F over a period of 1 hour under a slow stream of nitrogen, at which point the mixture was whitish with a finely dispersed precipitate. It was cooled to 100° F and 18 grams of methyl iodide were cautiously added. The reaction mixture was stirred for 1 hour and then cautiously hydrolyzed with 200 milliliters of water. The product was water-washed, dried, and stripped under vacuum to a temperature of 392° F (200° C) at 1 mm (the initial boiling point of the starting oligomer oil) to remove solvent, low-boiling products, and molecular iodine. The product was clay treated. It was colorless, with a viscosity of 20.05 centistokes at 100° F. Pyrolysis in an inert atmosphere, followed by iodometric titration (starch-thiosulfate) indicated that it contained 76 ppm chemically combined iodine.

The ability of this composition to inhibit the thermal decomposition of an untreated oligomer oil was demonstrated as follows: a hydrogenated decene oligomer oil containing about 77% hydrogenated trimer and 23% hydrogenated tetramer and having a kinematic viscosity of 18.17 centistokes at 100° F was subjected to the 1 hour 680° F thermal stability test, using the trap to collect volatile cracking products. Seven milliliters of cracking products were collected, and the final viscosity of the oligomer oil was only 7.77 centistokes — a 57.24% decrease.

A solution of 10% of the inhibitor composition in the same oligomer oil was subjected to the same test. After 1 hour at 680° F, the viscosity at 100° F had dropped from 18.25 centistokes to 12.16 centistokes — a decrease of only 33.37%. No cracking products were collected in the trap. Thus the addition of the composition of my invention clearly inhibited the thermal decomposition of the untreated oligomer oil.

The inhibitor composition of my invention may be utilized, alone or as an additive in untreated oligomer oils, in applications where the oligomer oils themselves are used — e.g. as a base oil for hydraulic fluids, lubricants, greases, and so on. It is especially useful in applications where the thermal instability of the ordinary oligomer oils is a potential drawback. The above examples are for the purpose of illustration only and are not meant to be limiting within the boundaries of the following claims.

I claim:

1. A composition of matter, prepared by the following process:

(a) reacting a hydrogenated linear alpha-olefin oligomer oil with an alkyllithium compound having the formula $C_nH_{2n+1}Li$, wherein "$n$" is an integer between 1 and 20, at a temperature of from 60° F to about 230° F, the ratio of alkyllithium compound to oligomer oil being about 0.02 to about 0.7 moles per mole of oligomer;

(b) adding to the mixture of step (a) an alkyl iodide having the formula $C_mH_{2m+1}I$, wherein "*m*" is an integer of from 1 to 10, at a temperature of from about 60° F to about 140° F, the ratio of alkyl iodide to alkyllithium being about 1 to 1.25 moles of alkyl iodide per mole of alkyllithium;

(c) cautiously hydrolyzing the mixture by the addition of water, and distilling to remove therefrom solvent and low-boiling byproducts, thereby obtaining said composition of matter, which is characterized by having viscosity properties similar to and improved thermal stability relative to the hydrogenated linear alpha-olefin starting material, and furthermore having the ability to inhibit the thermal decomposition of hydrogenated linear alpha-olefin oligomer oils when added in minor amounts thereto.

2. The composition of matter prepared by the process of claim 1, employing as the alkyl lithium compound n-butyl lithium.

3. The composition of matter prepared by the process of claim 1, employing as the alkyl iodide methyl iodide.

4. The composition of matter prepared by the process of claim 1, wherein a low-boiling n-alkane is employed as solvent.

5. A composition of matter useful as a base oil for hydraulic fluids, lubricants, and greases, said composition comprising a major amount of a hydrogenated linear alpha-olefin oligomer oil and a minor amount of the composition of claim 1.

6. A method of inhibiting the thermal decomposition of hydrogenated linear alpha-olefin oligomer oils by adding thereto a minor amount of the composition of claim 1.

* * * * *